US007584633B2

(12) United States Patent
Kim et al.

(10) Patent No.: US 7,584,633 B2
(45) Date of Patent: Sep. 8, 2009

(54) SPRAY TYPE DRUM WASHING MACHINE

(75) Inventors: Jin Woong Kim, Kyungki-do (KR); Kyung Chul Woo, Seoul (KR); Soo Young Oh, Seoul (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 539 days.

(21) Appl. No.: 10/822,748

(22) Filed: Apr. 13, 2004

(65) Prior Publication Data

US 2004/0237603 A1 Dec. 2, 2004

(30) Foreign Application Priority Data

Apr. 14, 2003 (KR) ..... 10-2003-0023320
Apr. 19, 2003 (KR) ..... 10-2003-0024911

(51) Int. Cl.

| | |
|---|---|
| ***B08B 3/00*** | (2006.01) |
| ***B08B 3/04*** | (2006.01) |
| ***B08B 3/06*** | (2006.01) |
| ***D06F 35/00*** | (2006.01) |
| ***D06B 1/00*** | (2006.01) |
| ***D06B 1/02*** | (2006.01) |

(52) U.S. Cl. ..... 68/5 R; 68/5 B; 68/24; 68/200; 68/207

(58) Field of Classification Search ..... 68/15, 68/5 B, 16, 207, 200, 5 R, 24, 5 C, 19.2, 68/20, 58, 205 R; 261/142; 8/149.2, 149.3
See application file for complete search history.

(56) References Cited

U.S. PATENT DOCUMENTS 3,180,037 A * 4/1965 Kenreich et al. ..... 34/597
4,489,574 A * 12/1984 Spendel ..... 68/16
4,527,343 A * 7/1985 Danneberg ..... 34/452
4,580,421 A * 4/1986 Babuin et al. ..... 68/12.13
4,684,064 A * 8/1987 Kwok ..... 239/223
4,903,508 A * 2/1990 Durazzani et al. ..... 68/4
5,232,476 A * 8/1993 Grant ..... 8/142

(Continued)

FOREIGN PATENT DOCUMENTS

DE 10260156 A1 * 7/2004

(Continued)

*Primary Examiner*—Michael Cleveland
*Assistant Examiner*—Nicole Blan
(74) *Attorney, Agent, or Firm*—Birch, Stewart, Kolasch & Birch, LLP

(57) ABSTRACT

A spray type drum washing machine including a tub mounted in a cabinet, and adapted to contain wash water therein, a circulation line connected between a portion of the tub and another portion of the tub to circulate wash water through the tub, a pump installed at the circulation line, and adapted to forcibly feed wash water through the circulation line for the circulation of the wash water through the tub, and an atomizing device provided at the circulation line, and adapted to atomize the wash water fed through the circulation line, whereby the wash water to circulate through the tub is supplied in an atomized state into the tub. The wash water can rapidly permeate clothes contained in the drum, so that it can more effectively come into contact with contaminants attached to the clothes. As a result, it is possible to achieve an enhancement in washing and rinsing performances while reducing the consumption of wash water.

20 Claims, 9 Drawing Sheets

U.S. PATENT DOCUMENTS

| | | | | |
|---|---|---|---|---|
| 5,385,037 | A * | 1/1995 | Bae | 68/16 |
| 5,887,456 | A * | 3/1999 | Tanigawa et al. | 68/20 |
| 6,117,219 | A * | 9/2000 | Muhr | 96/224 |
| 6,183,175 | B1 * | 2/2001 | Gafner | 409/74 |
| 6,338,438 | B1 * | 1/2002 | Walzel et al. | 239/7 |
| 6,585,781 | B1 * | 7/2003 | Roseen | 8/149.1 |
| 6,722,165 | B2 | 4/2004 | Woo et al. | |
| 6,789,404 | B2 * | 9/2004 | Kim et al. | 68/15 |
| 6,840,068 | B2 * | 1/2005 | Pasin et al. | 68/5 C |
| 7,047,666 | B2 * | 5/2006 | Hahn et al. | 34/499 |
| 7,062,863 | B2 * | 6/2006 | Chung | 34/596 |

FOREIGN PATENT DOCUMENTS

| | | | |
|---|---|---|---|
| EP | 1431443 | A1 * | 6/2004 |
| WO | WO 200111134 | A1 * | 2/2001 |

* cited by examiner

SPRAY TYPE DRUM WASHING MACHINE

The Non-provisional application claims priority under 35 U.S.C. & 119 (a) on patent application Ser. No. (s) 10-2003-0023320 and 10-2003-0024911 filed in Korea on Apr. 14, 2003 and Apr. 19, 2003, respectively, the entire contents of which are hereby incorporated by reference.

BACKGROUND OF THE INVENTION

1. Field of the Invention

The present invention relates to a drum washing machine adapted to wash clothes, and more particularly to a spray type drum washing machine capable of atomizing wash water contained in a tub, and spraying the atomized wash water into a drum, thereby achieving an enhancement in washing performance.

2. Description of the Related Art

Drum washing machines are generally adapted to wash laundry contained in a drum, such as clothes or bedding, through wash, rinse, and spin-dry cycles, in order to remove contaminants attached to the laundry in accordance with the action of wash water contained in a tub.

FIG. 1 is a partially-broken perspective view illustrating a conventional drum washing machine. FIG. 2 is a sectional view illustrating the conventional drum washing machine.

As shown in FIGS. 1 and 2, the conventional drum washing machine includes a base 1, and a cabinet 2 installed on the base 1 while defining the appearance of the washing machine. The cabinet 2 is provided with an access opening 2*a* for loading and unloading of clothes m. The conventional drum washing machine also includes a door 4 hingably mounted to a front wall of the cabinet 2, and adapted to open and close the access opening 2*a*, a tub 6 mounted in the cabinet 2 while being supported by a damper, a water supply unit 10 adapted to supply wash water w into the tub 6, a drainage unit 12 adapted to drain the wash water w from the tub 2 to the outside of the cabinet 2, a drum 20 rotatably mounted in the tub 6, and adapted to contain clothes therein, and a drum motor 30 adapted to rotate the drum 20.

The tub 6 is provided with an access opening 7 arranged in rear of the access opening 2*a* of the cabinet 2 to allow the user to put clothes m into the drum 20 and to take the clothes out of the drum 20.

The drum 20 is also provided with an access opening 21 arranged in rear of the access opening 2*a* of the cabinet 2 to allow the user to put clothes m into the drum 20 and to take the clothes out of the drum 20. The drum 20 is arranged such that a bottom portion thereof is dipped in wash water contained in the tub 6. The drum 20 is also formed with a plurality of water holes 22 at peripheral and rear walls thereof to allow wash water to flow between the tub 6 and the drum 20.

Lifters 26 are mounted to an inner peripheral surface of the drum 20. The lifters 26 serve to raise clothes contained in the drum 20 to the top of the drum 20, and then to release the clothes, thereby allowing the clothes to be dropped due to gravity.

The drum motor 30 is mounted to a rear wall of the tub 6 at the outside of the tub 6. The drum motor 30 has a rotating shaft 32 extending horizontally or approximately horizontally through a central portion of the rear wall of the tub 6 into the drum 20. The rotating shaft 32 is connected to a central portion of a rear wall of the drum 20.

In FIG. 1, reference numeral 48 designates a gasket mounted to the tub 6, and adapted to prevent leakage of wash water between the access openings of the door 4 and tub 6 in a closed state of the door 4.

Operation of the conventional drum washing machine having the above described configuration will now be described.

When the drum washing machine is operated under the condition in which the door 4 has been closed after clothes m have been put into the drum 20, wash water is supplied into the tub 6 in accordance with operation of the water supply unit 10, so that it is contained in a bottom portion of the tub 6. In this state, the bottom portion of the drum 20 is also dipped in the wash water as the wash water is introduced into the drum 20 through the water holes 22. As a result, the clothes in the drum 20 are wetted by the wash water.

Thereafter, the motor 30 is driven to rotate the drum 20. Thus, the clothes m contained in the drum 20 are repeatedly raised and dropped in the drum 20. As a result, stains are removed from the clothes m in accordance with the frictional action of the wash water and the inner surface of the drum 20.

After completion of this wash cycle, the wash water existing in the water tub 10 in a contaminated state is externally drained from the drum washing machine through the drainage unit 12.

Subsequently, the drum washing machine performs, several times, a rinse cycle for rinsing the washed clothes m to remove bubbles remaining on the clothes m. In this rinse cycle, wash water is supplied into the tub 6 by the water supply unit 10. Thereafter, the drum motor 30 is driven to rotate the drum 20, thereby causing the clothes m contained in the drum 20 to be repeatedly raised and dropped in the drum 20. As a result, bubbles are removed from the clothes m.

The contaminated wash water containing the removed bubbles is externally drained from the washing machine through the drainage unit 12.

After performing the rinse cycle several times, the washing machine performs a spin-dry cycle to remove moisture form the clothes m.

That is, when the drum motor 30 rotates the drum 20 at high speed, moisture permeated into the clothes m is centrifugally removed from the clothes m, and then collected in the tub 6 after being discharged from the drum 20 through the water holes 22. Finally, the collected moisture is externally drained through the drainage unit 12.

In the above mentioned conventional drum washing machine, however, there is a problem in that the clothes put into the drum 20 are simply naturally wetted by wash water supplied into the drum 20 or contained in the tub 6. That is, detergent supplied into the drum 20 is insufficiently dissolved in the wash water. Also, the speed, at which wash water permeates the clothes, is low.

Furthermore, although washing of clothes is carried out in the conventional drum washing machine, using wash water contained in the tub 6, a part of the wash water contained in the tub 6 may be insufficiently used in the clothes washing process. In order to obtain sufficient washing performance, it is necessary to use a large amount of wash water.

SUMMARY OF THE INVENTION

Therefore, the present invention has been made in view of the above mentioned problems involved with the related art, and it is an object of the invention to provide a spray type drum washing machine in which wash water contained in a tub is atomized to be sprayed into a drum, thereby being capable of achieving an enhancement in washing and rinsing efficiencies while using a reduced amount of wash water in accordance with circulation of the sprayed wash water.

Another object of the invention is to provide a spray type drum washing machine in which wash water circulating in the drum washing machine is heated to generate steam, and the generated steam is sprayed into the drum, thereby being capable of achieving an enhancement in washing and sterilization performances.

In accordance with one aspect, the present invention provides a spray type drum washing machine comprising: a cabinet; a tub mounted in the cabinet, and adapted to contain wash water therein; a circulation line connected between a portion of the tub and another portion of the tub to circulate wash water through the tub; a pump installed at the circulation line, and adapted to forcibly feed wash water through the circulation line for the circulation of the wash water through the tub; and atomizing means provided at the circulation line, and adapted to atomize the wash water fed through the circulation line, whereby the wash water to circulate through the tub is supplied in an atomized state into the tub.

The atomizing means may comprise a case arranged at the circulation line, and adapted to allow wash water to pass therethrough, diffusion means provided at an inlet portion of the case, and adapted to diffuse wash water to be introduced into the case, thereby atomizing the wash water, and a blowing fan adapted to forcibly feed, into the tub, the atomized wash water emerging from the diffusion means.

The diffusion means may comprise at least one centrifugal plate adapted to be rotated about an axis passing through a center thereof by a driving force, and a diffusion net arranged around the centrifugal plate, and adapted to diffuse wash water radially projected from the centrifugal plate in an atomized state.

The at least one centrifugal plate may comprise a plurality of centrifugal plates axially spaced apart from one another.

The centrifugal plate and the blowing fan may be rotated by a dual-shaft motor adapted to generate the driving force.

The circulation line may be provided, at an outlet end thereof, with a diffusion nozzle.

The spray type drum washing machine may further comprise a steam generating device installed at the circulation line, and adapted to heat the atomized wash water emerging from the atomizing means, thereby changing the atomized wash water into steam, and to supply the steam into the tub.

The steam generating device may comprise a container arranged at the circulation line, and adapted to allow the atomized wash water emerging from the atomizing means to pass therethrough, and a heater adapted to heat the atomized wash water passing through the container.

The steam generating device may further comprise temperature sensing means adapted to measure an internal temperature of the container.

In accordance with another aspect, the present invention provides a spray type drum washing machine comprising: a cabinet; a tub mounted in the cabinet, and adapted to contain wash water therein; a circulation line connected between a portion of the tub and another portion of the tub to circulate wash water through the tub; a pump installed at the circulation line, and adapted to forcibly feed wash water through the circulation line for the circulation of the wash water through the tub; atomizing means provided at the circulation line, and adapted to atomize the wash water to circulate through the tub; and steam generating means installed at the circulation line, and adapted to heat the atomized wash water emerging from the atomizing means, thereby changing the atomized wash water into steam, and to supply the steam into the tub.

In accordance with still another aspect, the present invention provides a spray type drum washing machine comprising: a cabinet; a tub mounted in the cabinet while carrying a drum therein, and adapted to contain wash water therein; a circulation line connected between bottom and top portions of the tub to circulate wash water through the tub; a pump installed at the circulation line, and adapted to forcibly feed wash water through the circulation line for the circulation of the wash water through the tub; atomizing means provided at the circulation line downstream from of the pump, and adapted to atomize the wash water to circulate through the tub; and a diffusion nozzle provided at an outlet end of the circulation line, and adapted to spray, into the tub, the wash water atomized while passing through the atomizing means.

The atomizing means may comprise a case arranged at the circulation line, and adapted to allow wash water to pass therethrough, at least one centrifugal plate arranged in the case, and adapted to centrifugally radially project the wash water introduced into the case, a diffusion net arranged around the centrifugal plate, and adapted to atomize the wash water centrifugally radially projected from the centrifugal plate when the wash water passes therethrough, a blowing fan adapted to forcibly feed, into the tub, the atomized wash water emerging from the diffusion net, and drive means adapted to rotate the centrifugal plate and the blowing fan.

The spray type drum washing machine may further comprise steam generating means installed at the circulation line, and adapted to heat the atomized wash water emerging from the atomizing means, thereby changing the atomized wash water into steam, and to supply the steam into the tub.

The steam generating device may comprise a container arranged at the circulation line, and adapted to allow the atomized wash water emerging from the atomizing means to pass therethrough, a heater adapted to heat the atomized wash water passing through the container, temperature sensing means adapted to measure an internal temperature of the container, and control means adapted to control the heater in accordance with a signal outputted from the temperature sensing means.

In the spray type drum washing machine according to one aspect of the present invention, wash water discharged from the tub is centrifugally radially projected by the centrifugal plates, and is then atomized while passing through the diffusion net. The atomized wash water is forcibly fed by the blowing fan so that it is sprayed into the drum. Accordingly, the wash water can rapidly permeate clothes contained in the drum, so that it can more effectively come into contact with contaminants attached to the clothes. As a result, it is possible to achieve an enhancement in washing and rinsing performances while reducing the consumption of wash water.

In the spray type drum washing machine according to another aspect of the present invention, wash water is atomized in the circulation line connected between the bottom and top of the tub to circulate wash water through the tub, and is then heated while passing through the container heated by the heater, so that steam is generated. Thus, hot steam is sprayed into the tub at the top of the tub. Accordingly, it is possible to rapidly wet clothes with wash water while obtaining enhanced sterilization and washing effects.

Since wash water particle formed in accordance with the atomization of wash water is changed into steam as it is heated, it is possible to effectively perform washing of clothes at high temperature, using a reduced amount of wash water. Accordingly, it is possible to reduce waste of wash water and electrical energy.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, embodiments of a spray type drum washing machine according to the present invention will be described in detail with reference to the annexed drawings.

Figure 1:
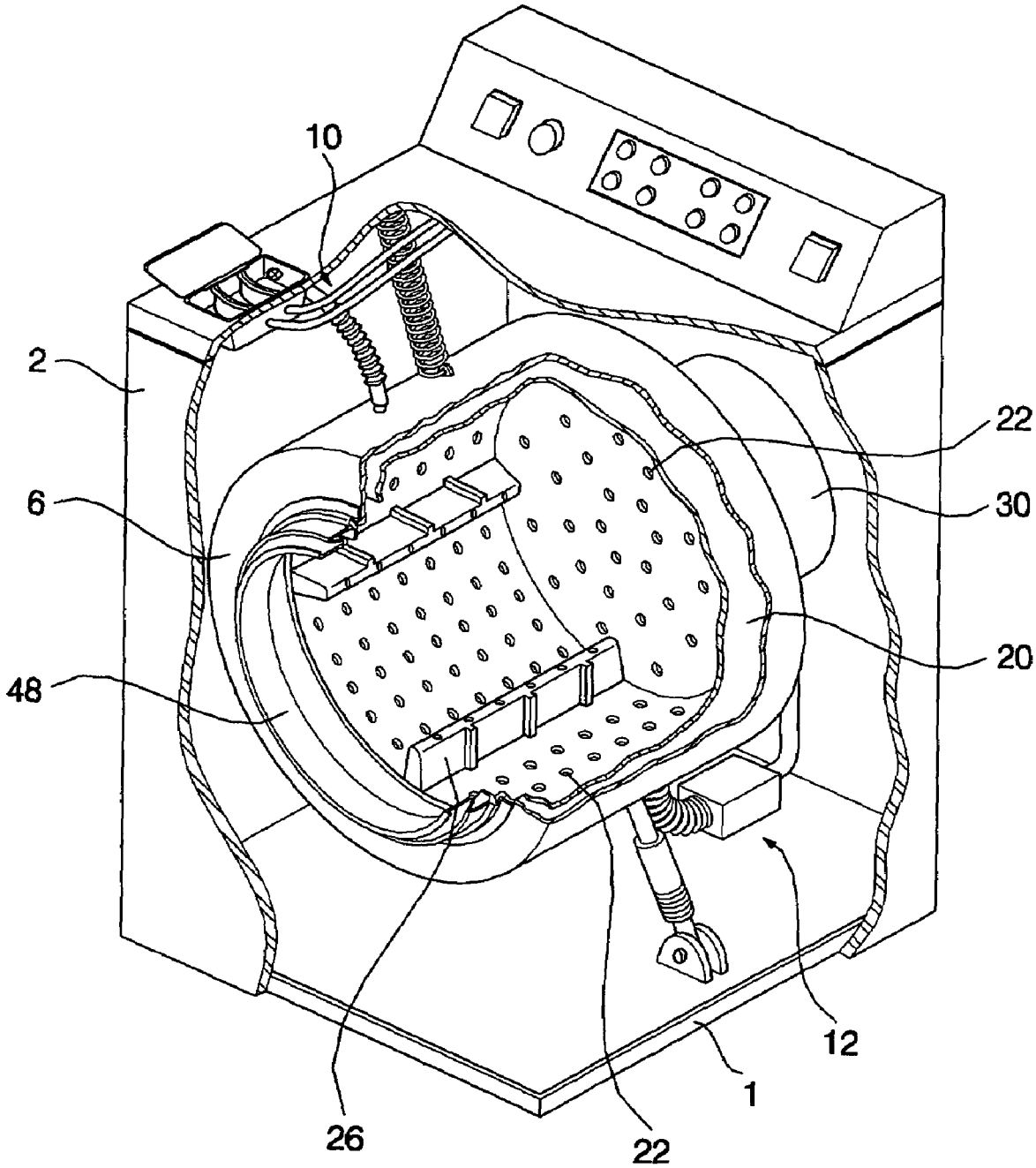
FIG. 1 (Prior Art)
FIG. 1 is a partially-broken perspective view illustrating a conventional drum washing machine.
Figure 2:
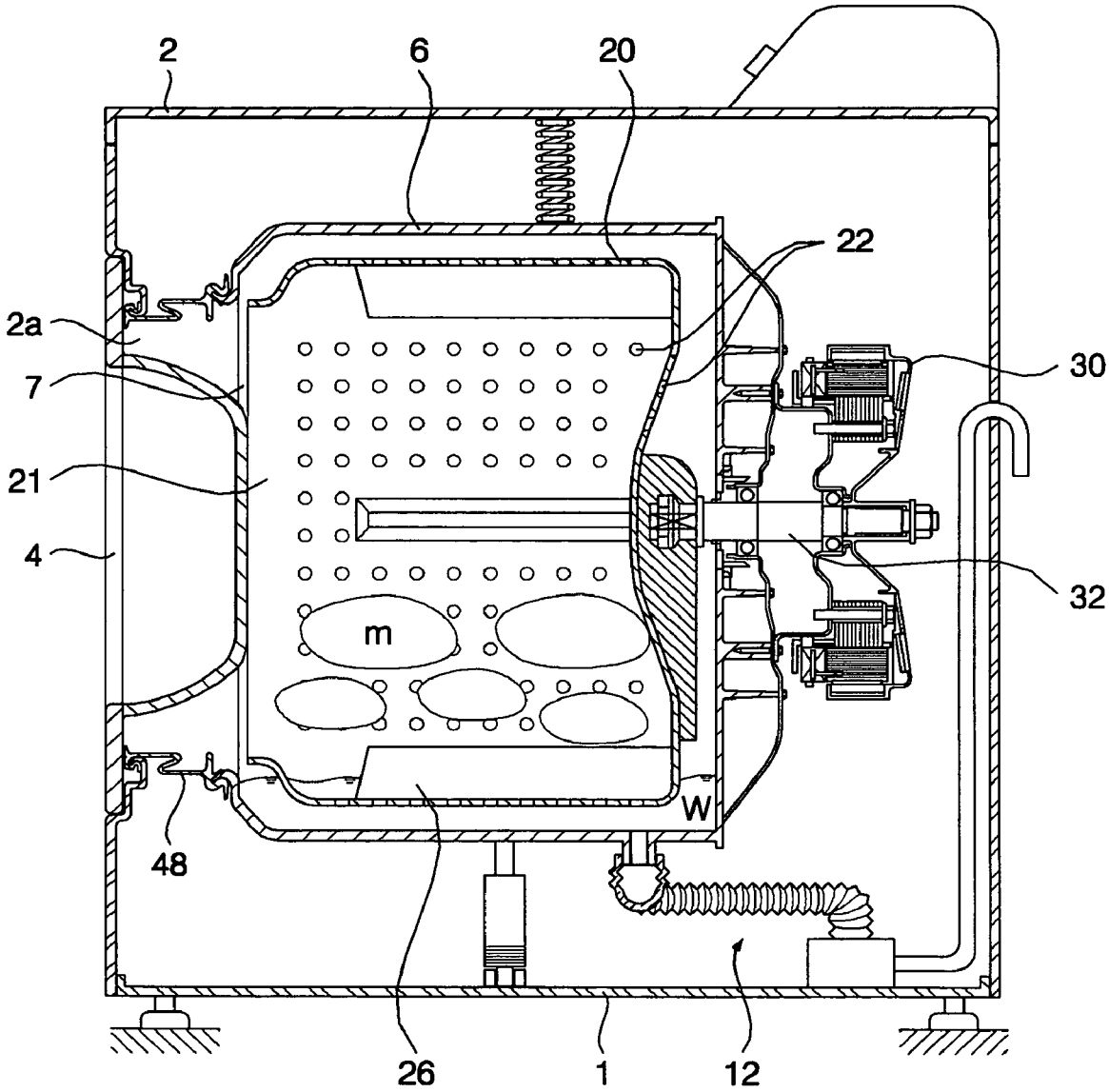
FIG. 2 (Prior Art)
FIG. 2 is a sectional view illustrating the conventional drum washing machine.
Figure 3:
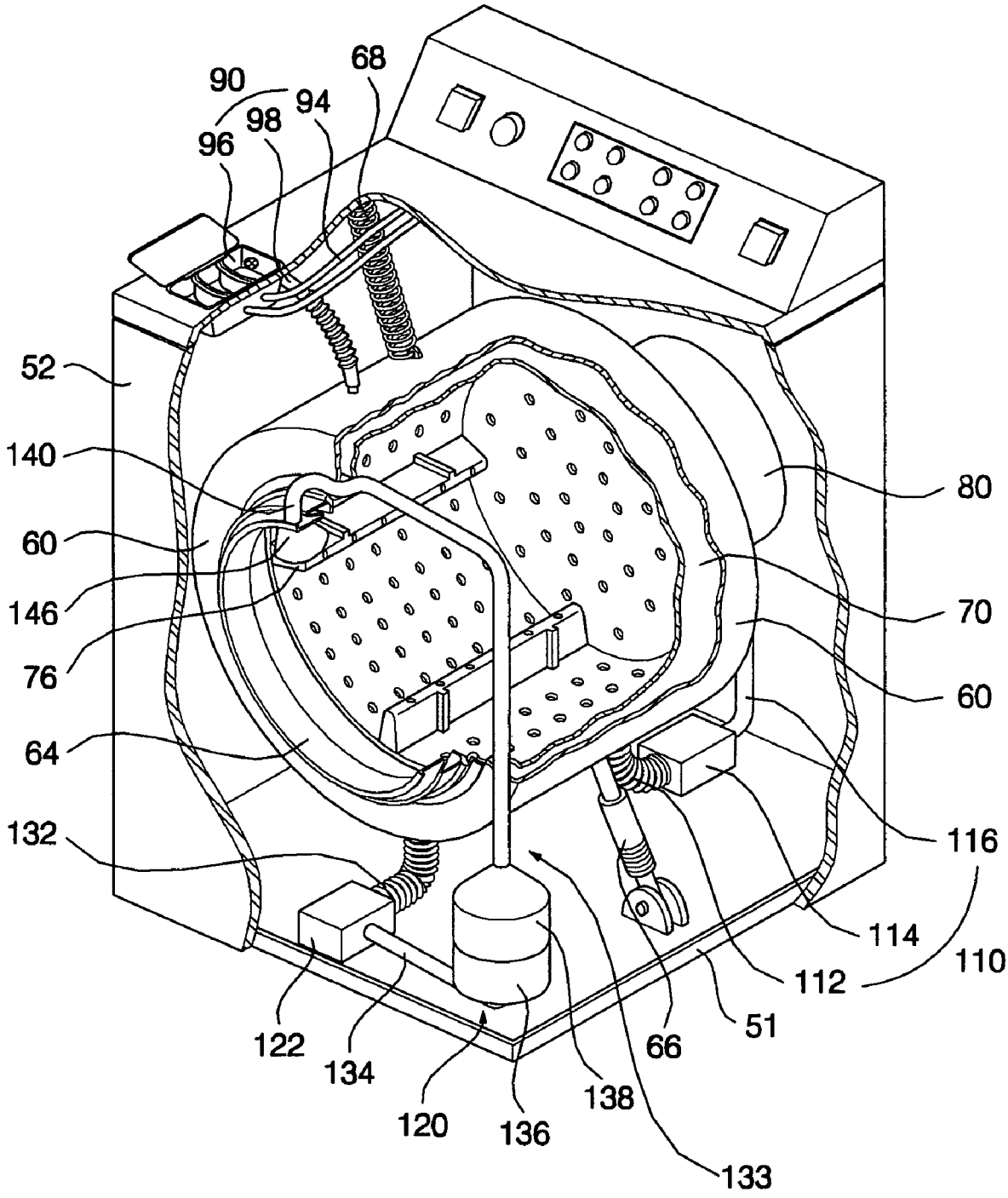
FIG. 3 is a partially-broken perspective view illustrating a spray type drum washing machine according to an embodiment of the present invention.
Figure 4:
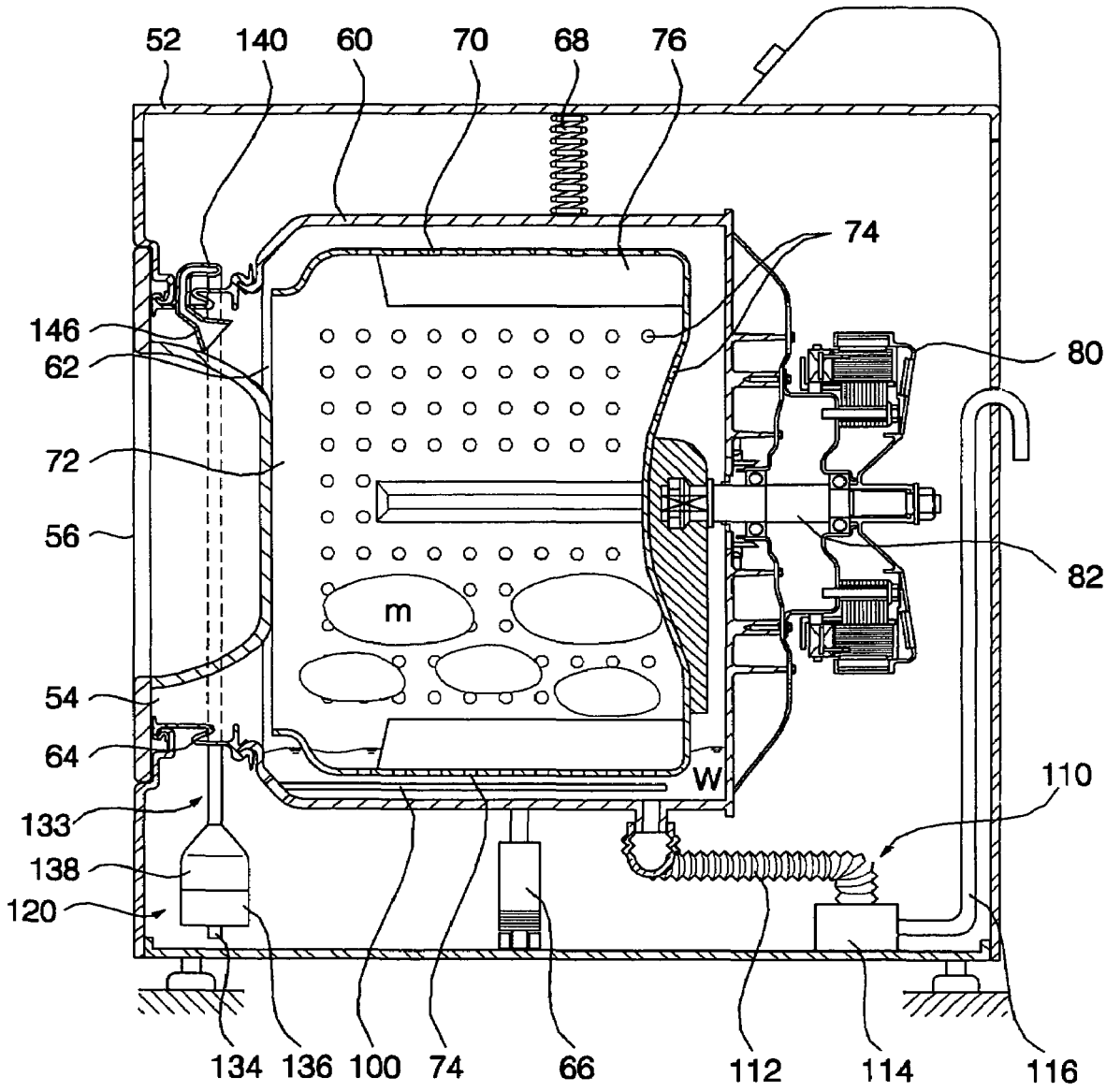
FIG. 4 is a sectional view illustrating the spray type drum washing machine according to the embodiment of the present invention.

FIG. 3 is a partially-broken perspective view illustrating a spray type drum washing machine according to an exemplary embodiment of the present invention. FIG. 4 is a sectional view illustrating the spray type drum washing machine according to the illustrated embodiment of the present invention.

As shown in FIGS. 3 and 4, the spray type drum washing machine according to the illustrated embodiment of the present invention includes a base 51, and a cabinet 52 installed on the base 51 while defining the appearance of the drum washing machine. The cabinet 2 is provided at a front wall thereof with an access opening 54 for loading and unloading of clothes m. A door 56 is hingably mounted to the front wall of the cabinet 52 to open and close the access opening 54.

A tub 60 is mounted in the cabinet 52 to contain wash water w therein.

The tub 60 is provided with an access opening 62 arranged in rear of the access opening 54 of the cabinet 52 to allow the user to perform loading and unloading of clothes m therethrough. A gasket 64 is fitted around the access opening 62 of the tub 60 to prevent wash water from being leaked between the door 56 and the access opening 54. The tub 60 is connected, at the bottom thereof, to a damper 66 mounted to the base 51 so that it is supported by the base 51 in a dampable state. The tub 60 is also connected, at the top thereof, to the top of the cabinet 52 via a spring 68 such that it is supported by the cabinet 52 in a suspended state while being dampable.

A drum 70 is arranged in the tub 60 to contain clothes.

The drum 70 is provided with an access opening 72 arranged in rear of the access openings 54 and 62 of the cabinet 52 and tub 60 to allow the user to put clothes m into the drum 70 and to take the clothes out of the drum 70. The drum 70 is also formed with a plurality of water holes 74 at peripheral and rear walls thereof to allow wash water to flow between the tub 60 and the drum 70. Lifters 76 are mounted to an inner peripheral surface of the drum 70. The lifters 76 serve to raise clothes contained in the drum 70 to the top of the drum 70, and then to release the clothes, thereby allowing the clothes to be dropped due to gravity.

The spray type drum washing machine also includes a drum motor 80 adapted to generate a drive force for rotating the drum 70.

The drum motor 80 is mounted to a rear wall of the tub 60 at the outside of the tub 60. The drum motor 80 has a rotating shaft 82 extending horizontally or approximately horizontally through a central portion of the rear wall of the tub 60 into the drum 70. The rotating shaft 82 is connected to a central portion of a rear wall of the drum 70.

Alternatively, the drum motor 80 may be mounted to the bottom of the tub 60, as compared to the above case in which the drum motor 80 is mounted to the rear wall of the tub 60. In this case, a separate shaft (not shown) is rotatably mounted to the rear wall of the tub 60 to extend horizontally or approximately horizontally through the central portion of the rear wall of the tub 60 into the drum 70. The shaft is connected to the rotating shaft of the drum motor 80 via a belt.

The spray type drum washing machine further includes a water supply unit 90 adapted to supply wash water into the tub 60, a heater 100 installed at the bottom of the tub 60 inside the tub 60, and adapted to heat wash water contained in the tub 60, a drainage unit 110 adapted to drain wash water from the tub 60 to the outside of the cabinet 52, an atomizing device 120 adapted to atomize wash water drained from the tub 60, a circulation line adapted to supply wash water from the tub 60 to the atomizing device 120, and to supply the atomized wash water into the drum 70, thereby circulating the wash water, and a pump 122 installed at the circulation line 133, and adapted to cause wash water to flow forcibly along the circulation line 133.

The water supply unit 90 includes a water supply hose 94 adapted to guide wash water, a detergent box 96 provided with a water supply passage for receiving wash water supplied through the water supply hose 94, and a detergent storing space communicating with an outlet of the water supply passage while being adapted to store detergent therein, and a water supply bellows 98 communicating with the tub 60 to guide wash water emerging from the detergent box 96 into the tub 60.

The drainage unit 110 includes a drainage bellows 112 communicating with a bottom portion of the tub 60 to drain wash water from the tub 60, a drainage pump 114 adapted to pump wash water drained from the tub 60 through the drainage bellows 112, and a drainage hose 116 adapted to guide the wash water emerging from the drainage pump 114 to the outside of the drum washing machine. In place of the drainage pump 114, a drainage valve may be used. In this case, the drainage valve opens or closes the drainage bellows 112 to allow or prevent drainage of wash water from the tub 60 through the drainage bellows 112.

The atomizing device 120 and circulation line 133 will be described in detail with reference to FIGS. 5 and 6.

Figure 5:
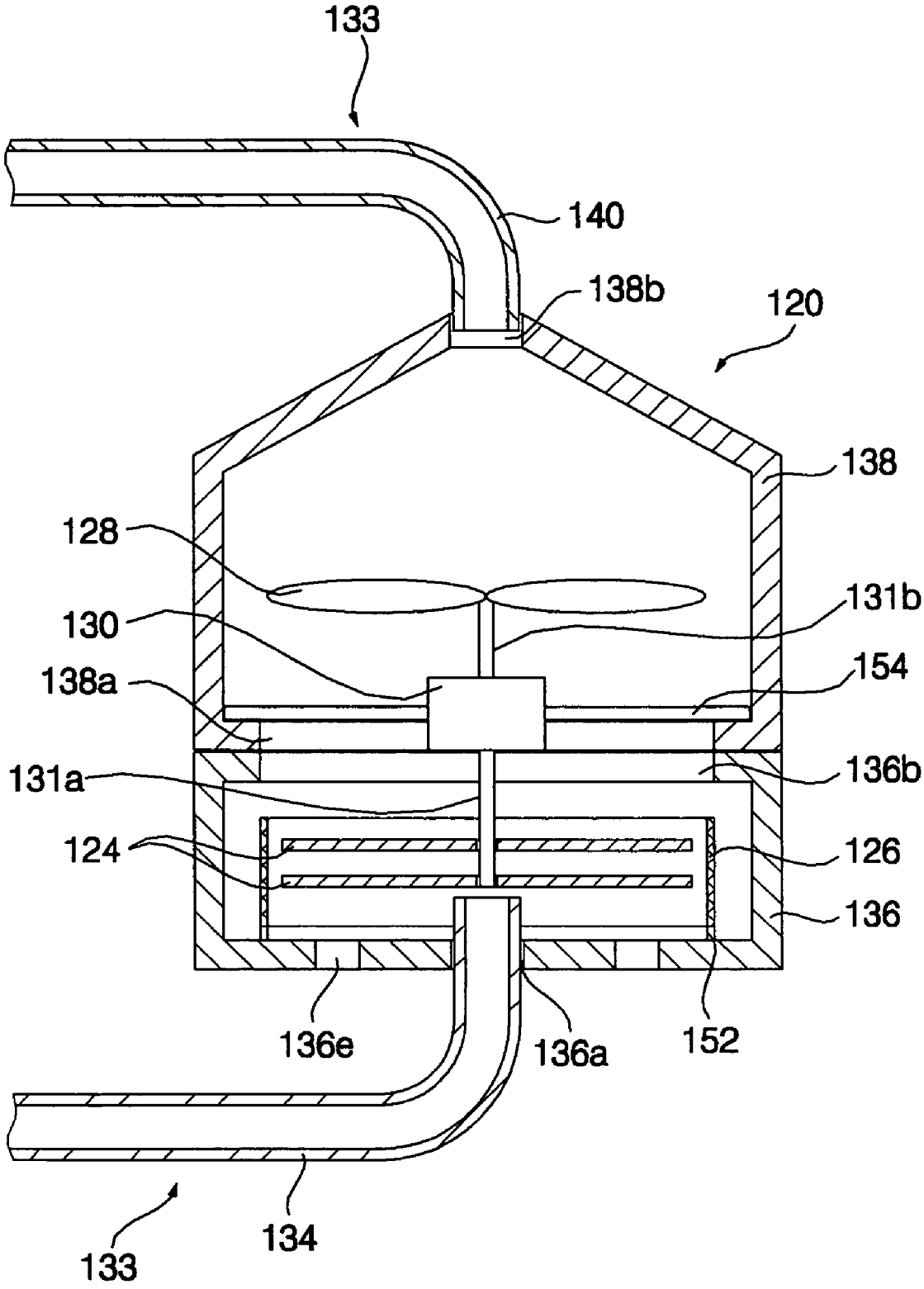
FIG. 5 is a sectional view illustrating an atomizing device and a circulation line included in the spray type drum washing machine according to the embodiment of the present invention.

FIG. 5 is a sectional view illustrating the atomizing device and circulation line. FIG. 6 is an exploded perspective view illustrating the atomizing device.

As shown in FIGS. 3 to 6, the atomizing device 120 includes a diffusion means including a case, through which wash water pumped by the pump 122 passes, centrifugal plates 124 adapted to centrifugally radially project wash water introduced into the case, and a diffusion net 126 arranged around the centrifugal plates 124, and adapted to atomize the wash water centrifugally radially projected from the centrifugal plates 124 when the projected wash water passes therethrough, a blowing fan 128 adapted to forcibly feed, into the tub 60, the wash water atomized while passing through the diffusion net 126, and a drive means adapted to rotate both the centrifugal plates 124 and the blowing fan 128, for example, a dual-shaft motor 130.

The case includes a net case 136 arranged around the diffusion net 126 to define a flow passage for guiding the atomized wash water, and a fan case 138 coupled to the net case 136, and arranged around the blowing fan 128 to define a flow passage for guiding the atomized wash water forcibly fed by the blowing fan 128.

As shown in FIG. 5, the centrifugal plates 124 are spaced apart from each other. Although two centrifugal plates 124 are shown in FIG. 5, an increased number of centrifugal plates may be used. Of course, a single centrifugal plate may be used. However, the former case is preferable because wash water flowing from one centrifugal plate 124 to another centrifugal plate 124 arranged downstream from the one centrifugal plate 124 along a peripheral edge of the upstream centrifugal plate 124 without being centrifugally radially projected can be centrifugally radially re-projected from the upstream plate 124, along with wash water returned to the upstream plate 124 after striking the diffusion net 126.

Figure 6:
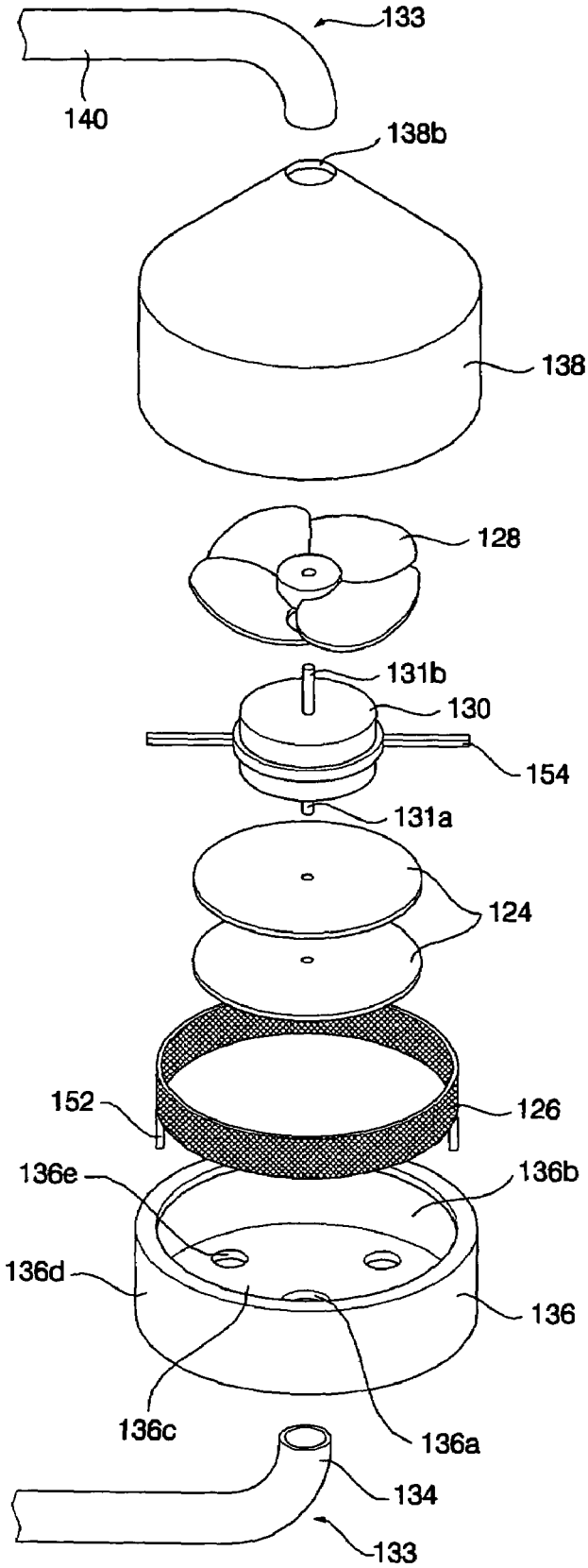
FIG. 6 is an exploded perspective view illustrating the atomizing device and circulation line included in the spray type drum washing machine according to the embodiment of the present invention.

As shown in FIGS. 5 and 6, the diffusion net 126 may have a circular strip structure having a height greater than the total height of the centrifugal plates 124 such that it completely surround the centrifugal plates 124. Alternatively, the diffusion net 126 may have a top portion upwardly spaced apart from an uppermost one of the centrifugal plates 124, a bottom portion downwardly spaced apart from a lowermost one of the centrifugal plates 124, and a peripheral portion arranged around the centrifugal plates 124, so that the diffusion net 126 completely surrounds the centrifugal plates 124.

As shown in FIGS. 5 and 6, the dual-shaft motor 130 includes a rotating shaft 131*a* extending axially through respective rotating centers of the centrifugal plates 124 to firmly support the centrifugal plates 124, and a rotating shaft 131b extending axially through a rotating center of the blowing fan 126 to firmly support the blowing fan 126, as shown in FIGS. 5 and 6. The dual-shaft motor 130 is arranged between the centrifugal plates 124 and the blowing fan 128.

As shown in FIGS. 3 to 6, the circulation line 133 includes a pump hose 132 connected, at one end thereof, to a drainage port formed at the tub 60 while being connected, at the other end thereof, to an inlet of the pump 122, in order to guide wash water from the tub 60 into the pump 122. The circulation line 133 also includes a first circulation pipe 134 connected, at one end thereof, to an outlet of the pump 122 while being connected, at the other end thereof, to the net case 136 such that the other end thereof is spaced apart from the centrifugal plates 124. The first circulation pipe 134 guides wash water pumped by the pump 122 into the net case 136. The circulation line 133 further includes a second circulation pipe 140 adapted to guide, into the drum 70, wash water forcibly fed by the blowing fan 128 in an atomized state.

The pump hose 132 may have, at a middle portion thereof, a bellows portion to prevent the ends thereof connected to the tub 60 and pump 122 from being separated from the tub 60 and pump 122.

The first circulation pipe 134 extends through the net case 136 such that the end thereof arranged in the interior of the net case 136 is spaced apart from a lower surface of the lowermost centrifugal plate 124.

The net case 136 is provided, at a wall thereof, with a through hole 136*a* adapted to allow the first circulation pipe 134 to extend therethrough. In the illustrated case, the through hole 136*a* is formed at the bottom wall 136*c* of the net case 136. The net case 136 is also provided, at a wall thereof facing the fan case 138, that is, the top wall thereof, with an opening 136*b* adapted to allow the forcibly fed atomized wash water to be introduced into the fan case 138. The net case 136 is also provided with a suction hole 136*e*, at the wall thereof having the through hole 136*a*, that is, the bottom wall 136*c* thereof, to suck air into the interior of the net case 136. Although the suction hole 136*e* is formed at the bottom wall 136*c* of the net case 136 in the illustrated case, it may be formed at a peripheral wall 136*d* of the net case 136.

The fan case 138 is provided, at a wall thereof facing the net case 136, that is, the bottom wall thereof, with an opening 138*a* to receive the atomized wash water from the net case 136. A discharge hole 138*b* is provided at the top wall of the fan case 138 to discharge the atomized wash water from the fan case 138.

The second circulation pipe 140 is connected, at one end thereof, to the discharge hole 138*b* of the fan case 138. The second circulation pipe 140 extends upwardly from the discharge hole 138*b* such that the other end thereof is upwardly protruded through a top portion of the gasket 64.

As shown in FIGS. 3 and 4, it is preferred that the other end of the second circulation pipe 140 be inclinedly arranged toward the center of the interior of the drum 70.

A trumpet-shaped diffusion nozzle 146 is mounted to the other end of the second circulation pipe 140 to allow the atomized wash water injected into the interior of the drum 70 to be spread in a diffused state.

In FIGS. 5 and 6, reference numeral 152 designates support rods adapted to firmly hold the diffusion net 126 in the net case 136 in a state of being spaced apart from the bottom of the net case 136. Reference numeral 154 designates a motor mounting member adapted to fixedly mount the dual-shaft motor 130 to the fan case 138.

Now, operation of the drum washing machine having the above described configuration according to the illustrated embodiment of the present invention will be described.

When the drum washing machine is operated under the condition in which the door 56 has been closed after clothes m have been put into the drum 70, as shown in FIGS. 3 and 4, wash water is supplied from the water supply unit 90 into the tub 6, so that it is contained in a bottom portion of the tub 6 while being contained in the pump hose 132.

In this state, the bottom portion of the drum 70 is also dipped in the wash water as the wash water is introduced into the drum 70 through the water holes 74. As a result, the clothes in the drum 70 are wetted by the wash water.

Thereafter, the drum motor 80 is driven to rotate the drum 70. Thus, the clothes m contained in the drum 70 are repeatedly raised and dropped in the drum 70. As a result, stains are removed from the clothes m in accordance with action of the wash water.

Meanwhile, both the pump 122 and the dual-shaft motor 130 are driven during the above described water supply cycle or wash cycle executed in the spray type drum washing machine. Accordingly, the wash water in the tub 60 is pumped by the pump 122. Also, the centrifugal plates 124 and blowing fan 128 are rotated in accordance with the operation of the dual-shaft motor 130.

The wash water pumped by the pump 122 is guided into the net case 136 via the first circulation pipe 134, and then strikes one surface of each centrifugal plate 124. Thereafter, the wash water is centrifugally radially projected toward the diffusion net 126 while being guided by the centrifugal plates 124, so that it is atomized while passing through the diffusion net 126.

The wash water atomized while passing through the diffusion net 126 is forcibly fed by the blowing fan 128 so that it is introduced into the second circulation pipe 140. The atomized wash water is then sprayed in the form of rain or mist into the drum 70 through the gasket 64 as it is discharged from the second circulation pipe 140.

The atomized wash water sprayed into the drum 70 through the gasket 64 directly wets the clothes m contained in the drum 70, so that it rapidly reacts upon contaminants attached to the clothes m, thereby enhancing the washability thereof.

After completion of the above described wash cycle, the wash water existing in the tub 60 in a contaminated state is externally drained from the tub 60 through the drainage unit 110.

Subsequently, the spray type drum washing machine performs, several times, a rinse cycle for rinsing the washed clothes m to remove bubbles remaining on the clothes m. In this rinse cycle, wash water is supplied into the tub 60 through the water supply unit 90. Thereafter, the drum motor 80 is driven to rotate the drum 70, thereby causing the clothes m contained in the drum 70 to be repeatedly raised and dropped in the drum 70. As a result, bubbles are removed from the clothes m.

Meanwhile, both the pump 122 and the dual-shaft motor 130 are driven during the above described water supply cycle or rinse cycle executed in the spray type drum washing machine. Similarly to the wash cycle, accordingly, the wash water in the tub 60 is pumped by the pump 122, and then atomized by the centrifugal plates 124 and diffusion net 126. Subsequently, the atomized wash water directly wets the clothes m contained in the drum 70, so that it rapidly rinses the clothes m to remove bubbles from the clothes m in accordance with an enhanced rinse ability thereof.

After completion of the above described rinse cycle, the wash water existing in the tub 60 in a contaminated state is externally drained from the tub 60 through the drainage unit 110.

After performing the rinse cycle several times, the drum washing machine performs a spin-dry cycle to remove moisture form the clothes m. That is, when the drum motor 80 rotates the drum 70 at high speed, moisture permeated into the clothes m is centrifugally removed from the clothes m, and then collected in the bottom portion of the tub 60 after being discharged from the drum 70 through the water holes 74. Finally, the collected moisture is externally drained through the drainage unit 110.

Figure 7:
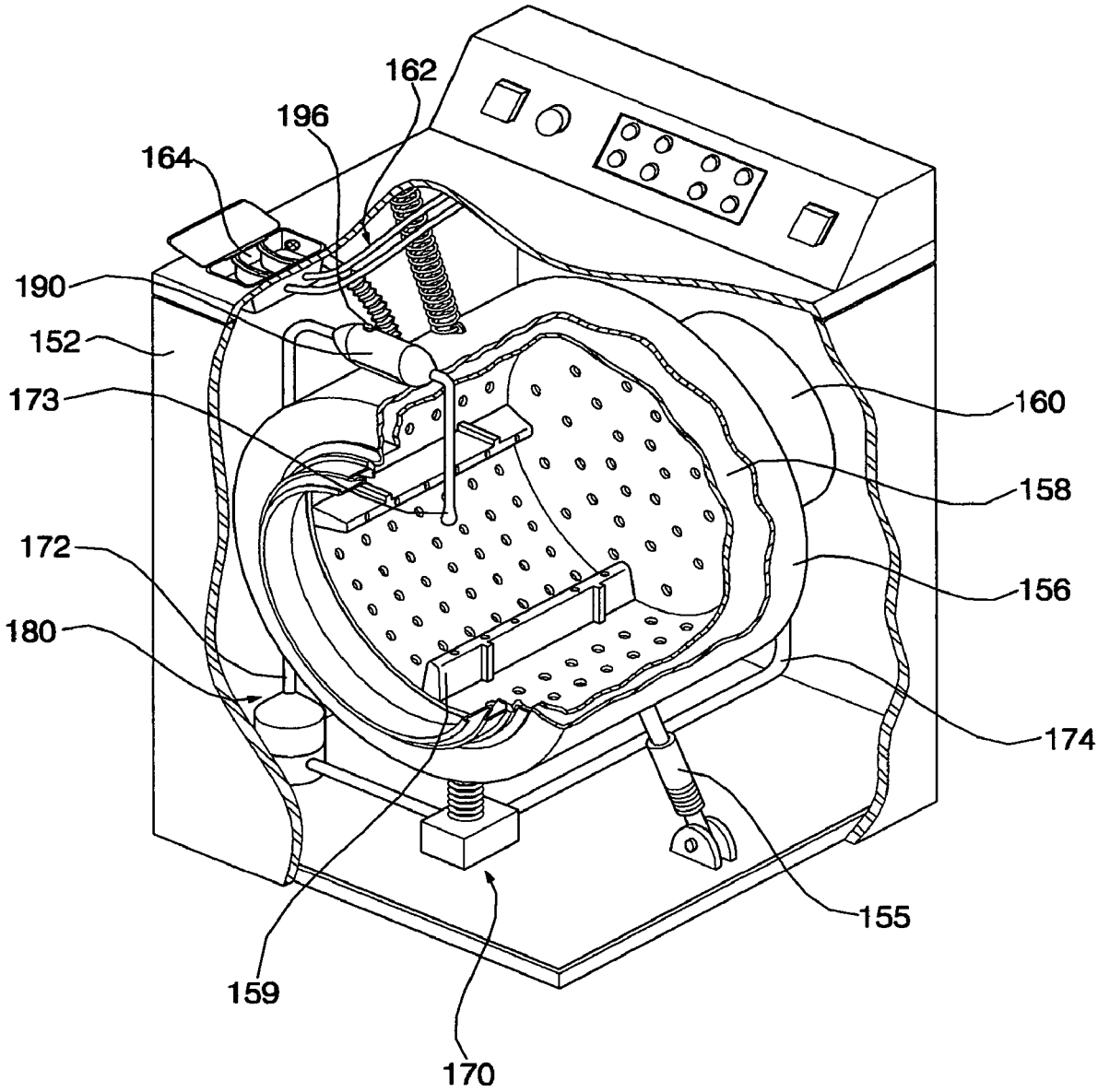
FIG. 7 is a partially-broken perspective view illustrating a spray type drum washing machine according to another embodiment of the present invention.
Figure 8:
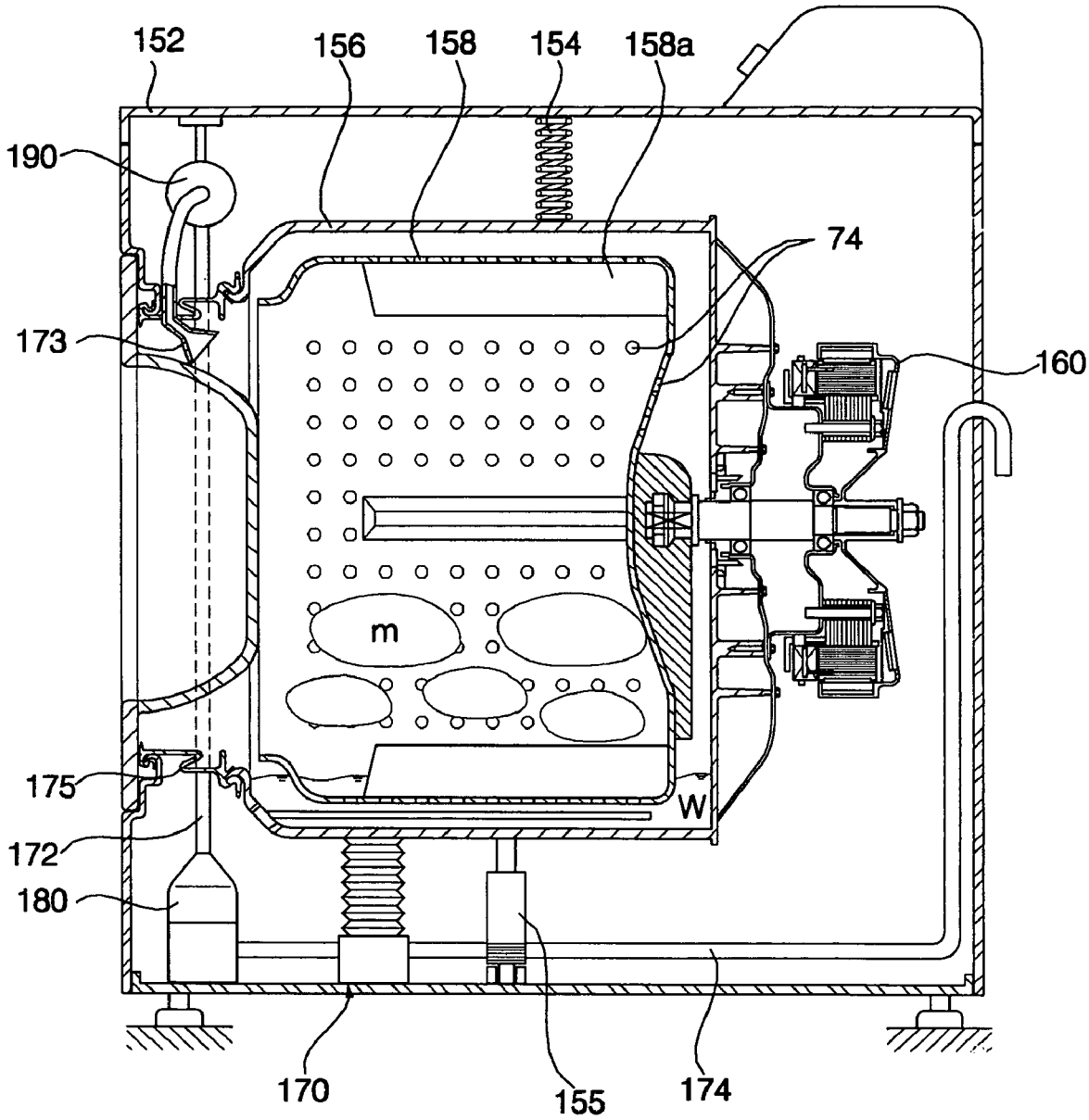
FIG. 8 is a sectional view illustrating the spray type drum washing machine according to the embodiment of the present invention illustrated in FIG. 7.

FIG. 7 is a partially-broken perspective view illustrating a spray type drum washing machine according to another embodiment of the present invention. FIG. 8 is a sectional view illustrating the spray type drum washing machine according to the embodiment of the present invention illustrated in FIG. 7.

As shown in FIGS. 7 and 8, the spray type drum washing machine according to this embodiment of the present invention includes a cabinet 152 defining the appearance of the drum washing machine, and a tub 156 mounted in the cabinet 152 such that it is connected, at the top thereof, to the top of the cabinet 152 via a spring 154 in a suspended state while being supported by a damper 155. The drum washing machine also includes a drum 158 rotatably mounted in the tub 156, and adapted to contain wash water and clothes m to be washed, and lifters 159 mounted to an inner peripheral surface of the drum 158 such that they are radially protruded from the inner peripheral surface of the drum 158 while being circumferentially uniformly spaced apart from one another. The lifters 159 serve to raise clothes contained in the drum 158 to the top of the drum 158, and then to release the clothes, thereby allowing the clothes to be dropped. The drum washing machine further includes a drum motor 160 connected with the drum 158, and adapted to rotate the drum 158, a water supply unit 162, and a detergent box 164. The water supply unit .162 and detergent box 164 are arranged above the tub 156 to simultaneously supply wash water and detergent into the tub 156 and drum 158.

The spray type drum washing machine further includes a circulation pump 170 installed at a circulation line 172 adapted to connect the bottom and top of the tub 156, and adapted to pump wash water from the bottom of the tub 156 to the top of the tub 156 via the circulation line 172 or to drain wash water from the tub 156 via a drainage line 174, an atomizing device 180 installed at the circulation line 172 such that it is connected to the circulation pump 170, and adapted to atomize wash water discharged from the circulation pump 170, and a steam generating device 190 installed at the circulation line 172 such that it is connected to the atomizing device 180, and adapted to heat wash water particulates emerging from the atomizing device 180, thereby changing the wash water particulates into steam.

The circulation line 172 extends vertically to connect the bottom and top of the tub 156. The circulation pump 170 is installed at a lower portion of the circulation line 172 connected to the bottom of the tub 156. The atomizing device 180 is installed at the circulation line 172 downstream from the circulation pump 170. The steam generating device 190 is installed at an upper portion of the circulation line 172 connected to the top of the tub 156.

The atomizing device 180 and steam generating device 190 will be described in detail with reference to FIGS. 9 and 10.

Figure 9:
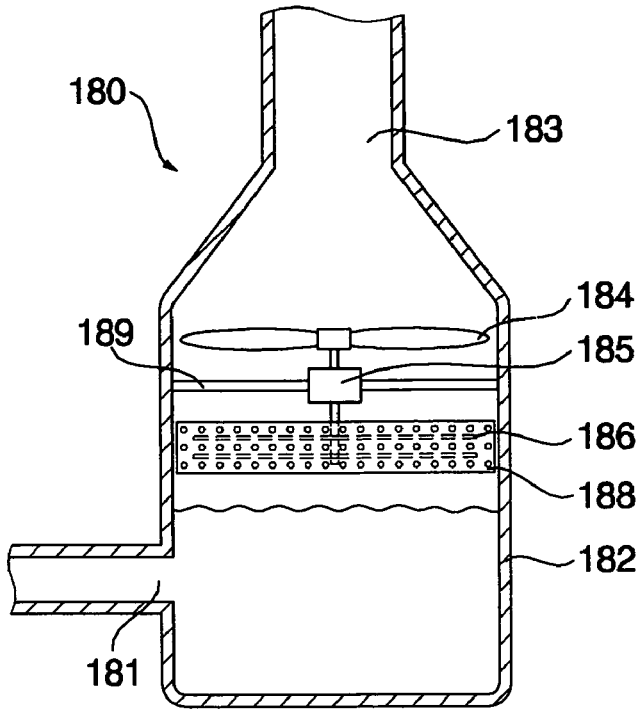
FIG. 9 is a sectional view illustrating an atomizing device included in the spray type drum washing machine according to the embodiment of the present invention illustrated in FIG. 7.
Figure 10:
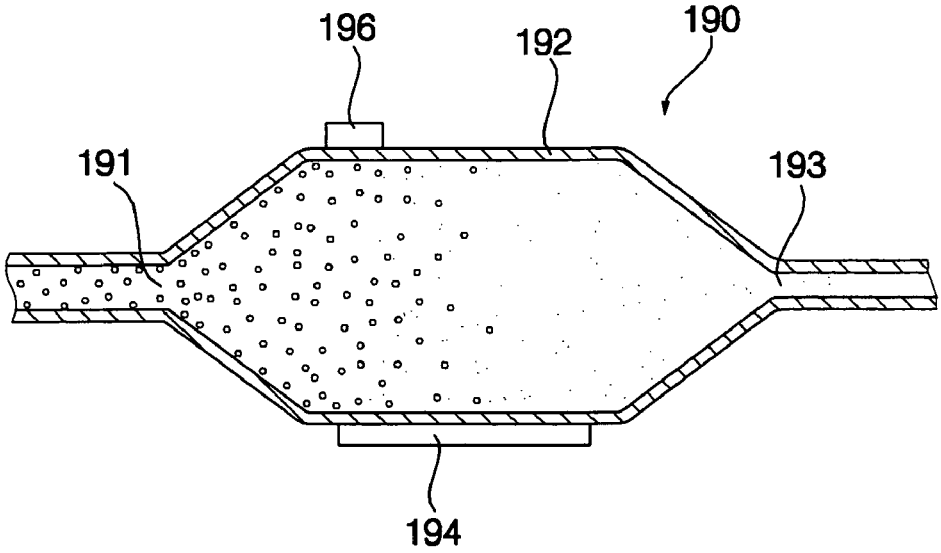
FIG. 10 is a sectional view illustrating a steam generating device included in the spray type drum washing machine according to the embodiment of the present invention illustrated in FIG. 7.

FIG. 9 is a sectional view illustrating the atomizing device. FIG. 10 is a sectional view illustrating the steam generating device.

The atomizing device 180 includes a case 182 installed at the circulation line 172 while being provided at a peripheral wall thereof with a suction port 181 for receiving wash water, and at a top wall thereof with a discharge port 183 for discharging wash water particulates, a blowing fan 184 rotatably mounted in the case 182, and adapted to blow the wash water particulates, and a dual-shaft motor 185 mounted in the case 182 beneath the blowing fan 184 such that it is connected with the blowing fan 184, and adapted to rotate the blowing fan 184. The atomizing device 180 also includes a plurality of centrifugal plates 186 arranged in the case 182 beneath the dual-shaft motor 185 such that it is connected to the dual-shaft motor 185, and adapted to rotate simultaneously with the blowing fan 184, thereby radially projecting the wash water introduced into the case 182 in accordance with a centrifugal force caused by the rotation thereof, and a diffusion net 188 arranged around the centrifugal plates 186 in a state of being spaced apart from the centrifugal plates 186, and adapted to atomize the wash water radially projected from the centrifugal plates 186.

The dual-shaft motor 185 is arranged in the case 182 in a state of being radially supported by the case 182. The dual-shaft motor 185 has upper and lower rotating shafts respectively connected to the blowing fan 184 and the centrifugal plates 186.

In FIG. 9, reference numeral 189 designates a motor mounting member adapted to mount the dual-shaft motor 185 to the case 182.

The steam generating device 190 includes a container 192 having an inlet 191 adapted to receive wash water particulates discharged from the atomizing device 180, and an outlet 193 arranged opposite to the inlet 191, and adapted to discharge steam, a heater 194 arranged on an outer surface of the container 192, and adapted to heat the container 192, and a temperature sensor 196 adapted to sense an internal temperature of the container 192, thereby allowing a control unit included in the drum washing machine to control operation of the heater 194, based on the temperature of steam existing in the container 192.

Of course, the container 192 is made of a material exhibiting a relatively high heat transfer coefficient. The heater 194 may be mounted to the bottom of the container 192. Also, the temperature sensor 196 may be mounted to the top of the container 192 while being electrically connected to the heater 194.

Meanwhile, the circulation line 172 extends, at an upper end thereof, through a gasket 175 arranged between the tub 156 and the cabinet 152 to prevent leakage of wash water. A diffusion nozzle 173 adapted to spray wash water or steam is mounted to the upper end of the circulation line 172 such that it is directed from the top and front end of the tub 156 toward the bottom and rear end of the tub 156.

Now, operation of the drum washing machine having the above described configuration according to the embodiment of the present invention illustrated in FIGS. 7 to 10 will be described.

When a wash cycle is begun under the condition in which clothes m have been put into the drum 158, a water supply valve (not shown) is opened, so that wash water is introduced into the water supply unit 162 and detergent box 164. As a result, the wash water is supplied into the tub 156 and drum 158, along with detergent. The amount of wash water supplied into the tub 156 is appropriately determined, based on the amount of clothes contained in the tub 156.

Under the condition in which an appropriate amount wash water has been supplied into the tub 156, the drum motor 160 is operated to rotate the drum 158. In accordance with the rotation of the drum 158, the lifters 159 raise the clothes m contained in the drum 158, and then release the clothes m at a certain level in the drum 158, thereby allowing the clothes m to be dropped. Thus, the wash cycle is executed.

When the circulation pump 170 is operated during the execution of the wash cycle in accordance with an associated operating condition set by the user, the wash water contained in the tub 156 is pumped from the bottom of the tub 156 to the top of the tub 156, and sprayed into the tub 156, so that effective flows of wash water are formed. In addition to such effective flows of wash water, an effect of beating the clothes m with the wash water is generated. Thus, an enhancement in washing performance is obtained.

In accordance with the operating condition set by the user, the dual-shaft motor 185 and heater 194 are operated, simultaneously with the operation of the circulation pump 170 to pump wash water into the circulation line 172. Accordingly, the wash water introduced from the bottom of the tub 156 into the circulation line 172 is sprayed into the tub 156 at the top of the tub 156 after being atomized and then changed into steam while sequentially passing through the atomizing device 180 and steam generating device 190.

This will be described in more detail. The wash water pumped by the circulation pump 170 is introduced into the case 182 via the circulation line 172. As the dual-shaft motor 185 operates, the blowing fan 184 and centrifugal plates 186 are rotated. As a result, the wash water introduced into the case 182 is radially projected after striking the centrifugal plates 186, and is than atomized in the form of particulates while passing through the diffusion net 188. The wash water particulates emerging from the diffusion net 188 are then discharged from the case 182 by the blowing fan 184. Thus, the wash water particulates are discharged from the atomizing device 180.

The wash water particulates discharged from the atomizing device 180 are introduced into the container 192 via the circulation line 172. As the heater 194 operates, the wash water particulates are heated while passing through the container 192, so that they are changed into hot steam. The hot steam is then sprayed into the tub 156 at the top of the tub 156 after passing through the circulation line 172.

Of course, the heater 194 is controlled by the temperature sensor 196, based on the temperature of steam in the container 192.

Thus, wash water is pumped from the bottom of the tub 156 during the wash cycle to pass through the atomizing device 180 and steam generating device 190, so that it is changed into hot steam, and then sprayed into the tub 156 at the top of the tub 156. Accordingly, it is possible to achieve an enhancement in washing and sterilization performances.

Where the above procedure is carried out prior to the supply of wash water into the tub 156, it is possible to rapidly wet the clothes by the hot steam, and thus, to achieve an enhancement in washing performance.

After completion of the wash cycle, the circulation pump 170 is operated in a state of being connected to the drainage line 174, so that it drains the wash water contained in the tub 156. After the drainage of wash water, the drum motor 160 is driven at high speed, so that the drum 158 is rotated at high speed to perform an intermittent spin-dry cycle for extracting wash water from the clothes in accordance with a centrifugal force generated during the rotation of the drum 158. After the spin-dry cycle, the water supply valve is re-opened to supply wash water into the drum 158. Simultaneously, the drum 158 is rotated. Thus, a rinse cycle is executed.

After repeated execution of the rinse cycle and intermittent spin-dry cycle, a spin-dry cycle is finally executed. Thus, washing of the clothes is completed.

As apparent from the above description, in the spray type drum washing machine according to the first embodiment of the present invention, wash water discharged from the tub is centrifugally radially projected by the centrifugal plates, and is then atomized while passing through the diffusion net. The atomized wash water is forcibly fed by the blowing fan so that it is sprayed into the drum. Accordingly, the wash water can rapidly permeate clothes contained in the drum, so that it can more effectively come into contact with contaminants attached to the clothes. As a result, it is possible to achieve an enhancement in washing and rinsing performances while reducing the consumption of wash water.

In the spray type drum washing machine according to the second embodiment of the present invention, wash water is atomized in the circulation line connected between the bottom and top of the tub to circulate wash water through the tub, and is then heated while passing through the container heated by the heater, so that steam is generated. Thus, hot steam is sprayed into the tub at the top of the tub. Accordingly, it is possible to rapidly wet clothes with wash water while obtaining enhanced sterilization and washing effects.

Since wash water particle formed in accordance with the atomization of wash water is changed into steam as it is heated, it is possible to effectively perform washing of clothes at high temperature, using a reduced amount of wash water. Accordingly, it is possible to reduce waste of wash water and electrical energy.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A laundry machine comprising:

a cabinet;

a drum mounted in the cabinet;

a mist generating device adapted to convert water to mist, whereby the water is supplied as a mist into the drum; and a mist transporting conduit having an inlet and an outlet, the mist transporting conduit being arranged downstream from the mist generating device, the inlet being connected to the mist generating device and the outlet arranged to deliver mist to the drum;

a tub located in the cabinet, the tub being adapted to contain water therein, and the drum being rotatably mounted in the tub; and a diffusion nozzle adapted to spray the mist into the drum.

2. The laundry machine according to claim 1, further comprising:

a steam generating device installed at the mist transporting conduit, and adapted to heat the mist emerging from the mist generating device, thereby changing the mist into steam, and supplying the steam into the tub.

3. The laundry machine according to claim 2, wherein the steam generating device comprises:

a container arranged at the mist transporting conduit, and adapted to allow the mist emerging from the mist generating device to pass therethrough; and a heater adapted to heat the mist passing through the container.

4. The laundry machine according to claim 3, wherein the steam generating device further comprises:

temperature sensing means adapted to measure an internal temperature of the container.

5. The laundry machine according to claim 1, wherein the sprayed mist is directed from the top and front end of the drum toward the bottom and rear end of the drum.

6. The laundry machine according to claim 1, further comprising:

a circulation line connected between a portion of the tub and another portion of the tub; and a pump installed at the circulation line, and adapted to forcibly feed water through the circulation line to circulate the water through the tub.

7. The laundry machine according to claim 6, wherein the mist generating device is provided at the circulation line and the diffusion nozzle is provided at an outlet end of the circulation line.

8. The laundry machine according to claim 7, further comprising a gasket fitted around an access opening of the tub, and wherein the outlet end of the circulation line is extended through a top portion of the gasket.

9. The laundry machine according to claim 1, further comprising a water-supply unit configured to supply water into the tub.

10. A laundry machine comprising:

a cabinet;

a drum mounted in the cabinet;

a mist generating device adapted to convert water to mist, whereby the water is supplied as a mist into the drum; and a mist transporting conduit having an inlet and an outlet, the mist transporting conduit being arranged downstream from the mist generating device, the inlet being connected to the mist generating device and the outlet arranged to deliver mist to the drum; and a water-supply unit configured to supply water into the drum.

11. The laundry machine according to claim 10, wherein the laundry machine is a washing machine.

12. The laundry machine according to claim 10, further comprising a water transporting conduit having an inlet and an outlet, the inlet being adapted to receive water from the drum, and the outlet being connected to the mist generating device.

13. The laundry machine according to claim 12, further comprising a pump arranged at the water transporting conduit.

14. A laundry machine comprising:

a cabinet;

a tub located in the cabinet, and adapted to the contain water therein;

a drum rotatably mounted in the tub;

a mist generating device adapted to convert water into mist;

a steam generating device adapted to heat the mist to change the mist into steam;

a circulation line including the mist generating device and the steam generating device, the circulation line being connected between a portion of the tub and another portion of the tub; and a pump installed at the circulation line, the pump being adapted to forcibly feed water through the circulation line to circulate the water through the tub.

15. The laundry machine according to claim 14, wherein the steam is directed from the top and front end of the drum toward the bottom and rear end of the drum.

16. The laundry machine according to claim 14, further comprising a gasket fitted around an access opening of the tub, and wherein the outlet end of the circulation line is extended through a top portion of the gasket.

17. The laundry machine according to claim 16, wherein the steam generating device heats the mist to generate steam.

18. The laundry machine according to claim 17, wherein the mist is converted to steam while flowing through the steam generating device.

19. The laundry machine according to claim 14, further comprising a diffusion nozzle configured to spray the mist or the steam.

20. The laundry machine according to claim 14, further comprising a water-supply unit configured to supply water into the tub.

* * * * *